United States Patent [19]

Shuler

[11] 3,975,995

[45] Aug. 24, 1976

[54] VENTILATED CEILING CONSTRUCTION

[75] Inventor: Bernard R. Shuler, Louisville, Ky.

[73] Assignee: American Air Filter Company, Inc., Louisville, Ky.

[22] Filed: Mar. 13, 1975

[21] Appl. No.: 557,979

[52] U.S. Cl. ..... 98/40 D; 55/418; 55/473; 55/484; 55/DIG. 29

[51] Int. Cl.[2] ..... F24F 7/00

[58] Field of Search ..... 98/40 D, 33 R; 55/418, 55/419, 473, 484, DIG. 29

[56] References Cited

UNITED STATES PATENTS

| | | | |
|---|---|---|---|
| 3,350,862 | 11/1967 | Nutting | 98/40 D X |
| 3,363,532 | 1/1968 | Horneff | 98/40 D X |
| 3,418,915 | 12/1968 | Marble | 55/484 X |
| 3,638,404 | 2/1972 | Moll et al. | 55/473 |
| 3,780,503 | 12/1973 | Smith | 55/418 |

*Primary Examiner*—William E. Wayner
*Assistant Examiner*—William E. Tapolcai, Jr.
*Attorney, Agent, or Firm*—Jon C. Winger

[57] ABSTRACT

An air filtering and distribution structure for an environmentally controlled enclosure, such as clean room, has a first planar surface having a mixed array of filter panels and blank panels spaced from a surface of the enclosure defining a dirty air plenum therebetween, and a second planar section of perforated air diffusing panels spaced from the first planar panel defining a clean air plenum therebetween.

4 Claims, 6 Drawing Figures

VENTILATED CEILING CONSTRUCTION

BACKGROUND OF THE INVENTION

The present invention relates to ventilation systems having air filtering and diffusing devices, and more particularly, to air filtering and diffusing ceilings and walls for environmentally controlled rooms.

Various air filtering and distribution structures for use in environmentally controlled rooms are known.

One type of ceiling construction for environmentally controlled rooms is a dropped ceiling formed entirely of filter panels defining a dirty air plenum between it and the ceiling of the room. The filter panels filter the dirty air as it passes from the dirty air plenum into the room, and, of course, since the entire dropped ceiling is formed of filter panels, distributes the air in a more or less uniform manner across the length and breadth of the ceiling for generally vertical flow across the room.

Yet another type of air filtering and distribution structure for a clean room is a wall formed entirely of filter panels having a dirty air plenum between it. The filter panels filter the dirty air as it passes from the dirty air plenum into the room, and, since the entire filter wall is formed of filter panels, distributes the air in a more or less uniform manner across the length and height of the filter wall for generally horizontal flow across the room.

Another type of ceiling construction is a dropped ceiling formed entirely of air deflecting panels which ceiling defines a conditioned air plenum between it and the ceiling of the room. The plenum receives temperature and humidity conditioned air through an air supply vent and deflecting elements formed in the dropped ceiling panels distribute the temperature and humidity conditioned air across the length and breadth of the ceiling as it passes from the plenum to the room.

In various industries, the parameters for an environmentally controlled room vary greatly depending upon the function to which the room will be put. In the pharmaceutical and aerospace fields, for example, the standards for air cleanliness are rigid. In other industries, for example, the precision gauging industries, the prime environmental consideration in an environmentally controlled room is uniform temperature and humidity control, with cleanliness being a parameter of secondary importance, the filter associated with a temperature and humidity conditioning apparatus being adequate to clean the air before it is introduced into the room.

One consideration which is common to every industry, however, is cost. Environmentally controlled rooms are very expensive and are usually considered capital expenditure items. An environmentally controlled room which cleans the air to a greater degree than is needed for the type of work done in the room is "over engineered" for the application and is therefore extremely wasteful.

The above-described environmentally controlled room air filtering and distribution structures represent, so to speak, opposite ends of the spectrum as it relates to cleaning the air admitted to an environmentally controlled room. The first and second mentioned constructions having a dropped ceiling or wall, respectively, formed entirely of filter panels represent that end of the spectrum requiring essentially absolute clean air while the third mentioned ceiling construction represents the other end of the spectrum requiring only a minimum degree of air cleanliness.

SUMMARY OF THE INVENTION

The present invention recognizes that some industrial applications require an environmentally controlled room having air cleanliness requirements somewhere between the two ends of the spectrum satisfied by the above-mentioned prior art. In this event, to have a ceiling or wall structure entirely formed of filter panels would be prohibitively expensive and wasteful, while to have a ceiling or wall structure formed only of air deflecting elements and relying only upon a filter at the temperature and humidity conditioning source would not fulfill the air cleanliness requirements.

The present invention further recognizes the drawbacks of the prior art ventilated ceiling and wall constructions and supplies a solution which meets air cleanliness standards which fall between the above-mentioned prior art constructions and which further still maintains a uniform air flow pattern across the length and breadth of the room in which it is installed. More particularly, the present invention provides an air filtering and distribution structure for use in an environmentally controlled enclosure, the structure comprising: a first planar section spaced a predetermined distance from one surface of the enclosure and defining a dirty air plenum therebetween, the first planar section comprising a mixed array of removably mounted filter panels and removably mounted black panels; and, a second planar section spaced a predetermined distance from the first planar section and defining a clean air plenum therebetween which receives the cleaned air passing through the filter panels of the first section from the dirty air plenum, the second section being constructed air diffusing panels to diffuse and distribute the clean air as it passes from the clean air plenum into the enclosure.

DESCRIPTION OF THE DRAWINGS

A better understanding of the present invention will be had upon reference to the accompanying drawings in which like numerals refer to like parts throughout the several views and in which.

DESCRIPTION OF THE PREFERRED EMBODIMENT

Figure 1:
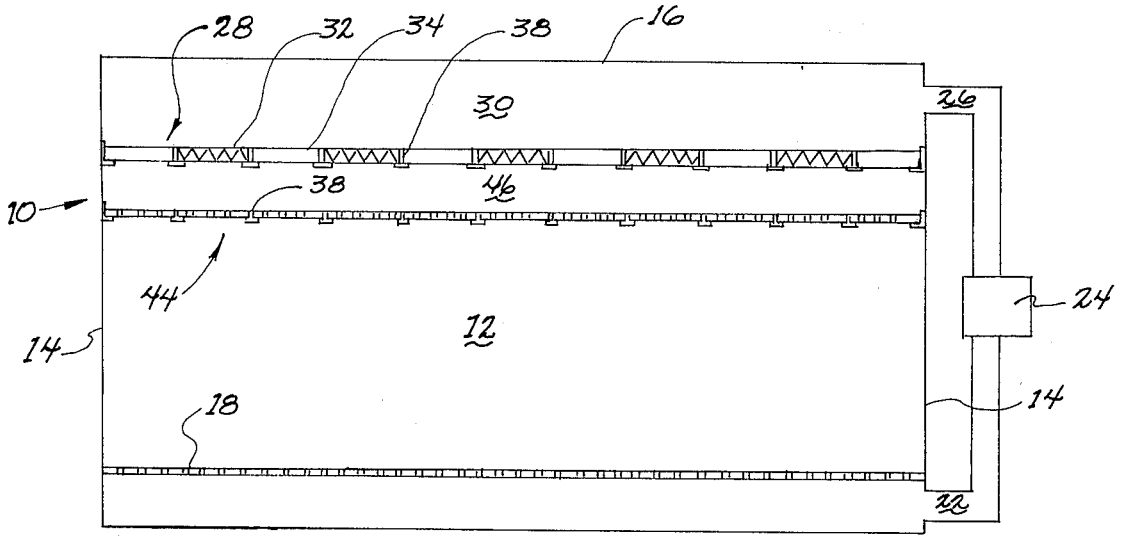
FIG. 1 is a cross-sectional view of an environmentally controlled enclosure having an air filtering and distributing ceiling structure according to the present invention installed therein.

With reference to FIG. 1, there is illustrated an air filtering and distribution structure of the present invention in the form of a ventilated ceiling construction, generally denoted as the numeral 10, installed in an environmentally controlled enclosure such as a clean room 12 having walls 14, a ceiling 16, and a raised perforated floor 18 defining an underfloor return air plenum 20.

Typically, the environmentally controlled room 12 further includes an air return duct 22 interconnecting the underneath floor return air plenum 20 and an air moving device such as a compressor 24 which may be associated with temperature and humidity control means (not shown) such as a furnace, air conditioner, humidifier and dehumidifier; and an air supply duct 26 interconnecting the compressor to the room 12.

Figure 2:
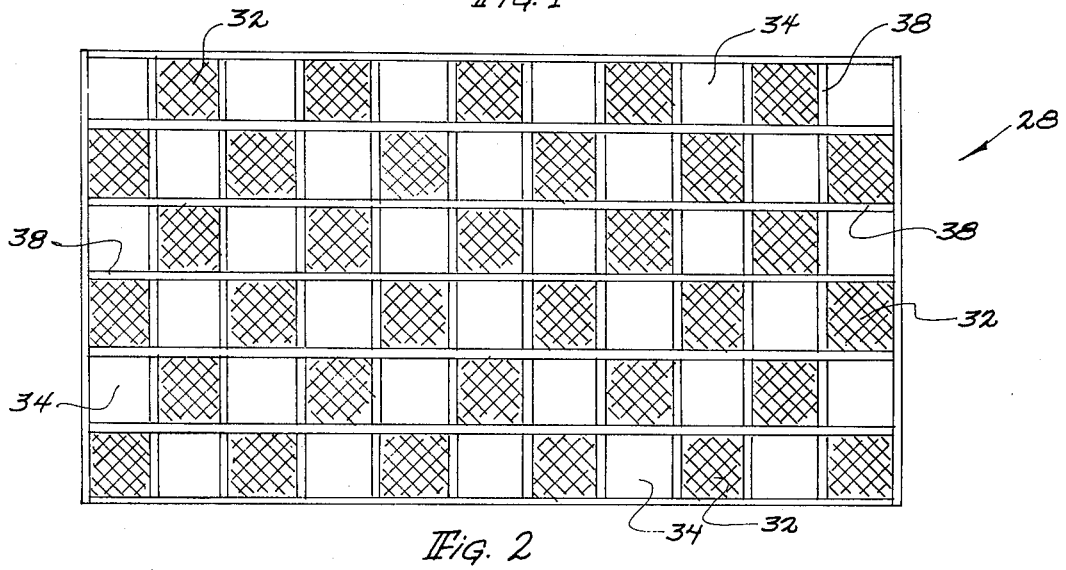
FIG. 2 is a plan view of a first dropped ceiling of the present invention viewed as if looking upwardly from a floor of the room.

With continued reference to FIG. 1, the ventilated ceiling construction 10 comprises a first planar section such as a dropped ceiling, generally denoted as 28, spaced a predetermined distance from the room ceiling 16 and defining an air supply plenum 30 between the first dropped ceiling 28, room ceiling 16 and room walls 14. The first dropped ceiling 28 comprises a mixed array of filter panels 32 and blank panels 34. The filter panels 32 and blank panels 34 preferrably have the same lateral dimensions and are interchangeable. The number of filter panels 32 incorporated in the first ceiling 28 is a function of the degree of air cleanliness required and will vary from installation to installation and consequently the pattern or arrangement of filter panels 32 will vary as a function of the number used to satisfy the air cleaning parameters. The blank ceiling panels 34 are disposed in the spaced between filter panels 32 to construct the first dropped ceiling 28 entirely comprised of filter panels 32 and blank panels 34 (see FIG. 2).

A supporting structure for the first dropped ceiling 28 can be virtually any conventional heretofore known structure. For example, the supporting structure is illustrated as comprising a plurality of horizontally disposed mutually perpendicular intersecting inverted T-channel members 38, defining a plurality of rectangular openings having lateral dimensions somewhat less than the lateral dimensions of the filter panels 32 and blank ceiling panels 34. The filter panels 32 and blank panels 34 are inserted in the openings and seated on the branches of the T-channel which extend inwardly of the openings. Additionally, a seal (not shown), is disposed between the panel 32 and 34 and the branch of the T-channel upon which is is seated to prevent leakage of dirty air from the dirty air plenum 30.

Figure 3:
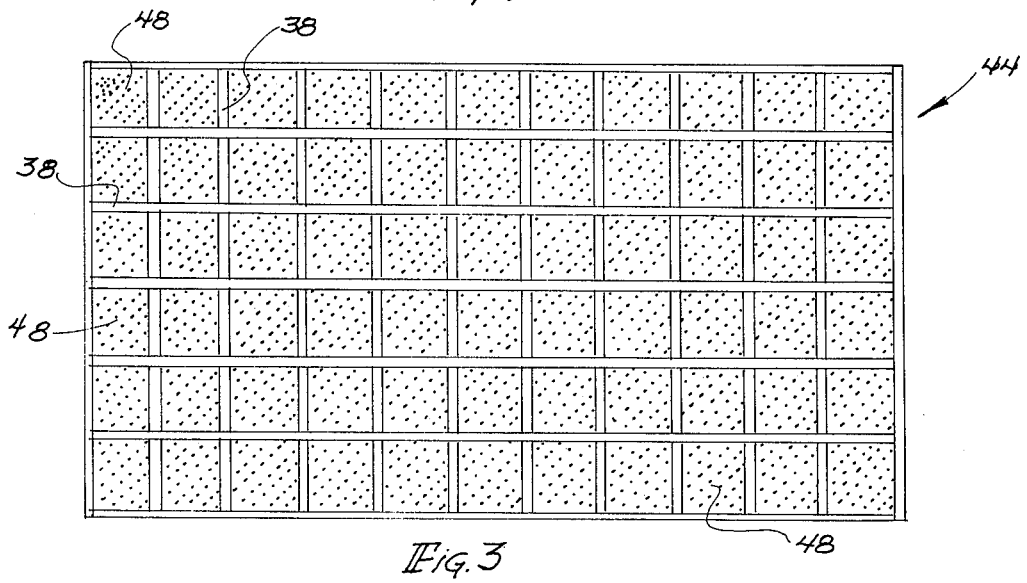
FIG. 3 is a plan view of a second dropped ceiling of the present invention viewed as if looking upwardly from the floor of the room.

As can be seen in FIG. 1, the ventilation ceiling construction 10 is further comprised of a second planar section such as a second dropped ceiling, generally denoted as 44, spaced a predetermined distance from the first dropped ceiling 28 to define a clean air plenum 46 between the second dropped ceiling 44 and first dropped ceiling 28. The second dropped ceiling 44 comprises a plurality of perforated air diffuser panels 48 which extend the length and breadth of the room (see FIG. 3).

As with the first dropped ceiling 28, the second dropped ceiling can be supported by virtually any known support structure and is illustrated as comprising the same type inverted T-beam structure 38 as supports the first dropped ceiling.

It should be noted that the filter panels 32 and blank panels 34 are easily removable from the support structure. This feature not only makes replacement of dirty filters easily accomplished, but also allows blank panels 34 to be easily replaced by filter panels 32 as air cleanliness requirements may change so that the ceiling construction 10 can be up-graded at a subsequent time after initial installation. Furthermore, the second dropped ceiling 44 can be easily removed in the event that the first dropped ceiling 28 is up-graded to contain all filter panels 32.

In operation, dirty air is received in the dirty air plenum 30 via the air supply duct 26 from the compressor 24, and the dirty air is filtered as it passes through the filter panels 32 of the first dropped ceiling 28 into the clean air plenum 46. The perforated air diffusing panels 48 of the panel second dropped ceiling 44 evenly distribute clean filtered air across the length and breadth of the room 12 as the clean filtered air passes from the clean air plenum 46 and into the room 12. In the illustrated clean room 12, the air is drawn out of the room 12 through the raised floor 15 into the return plenum 20 and out through the return duct 22, thus, providing generally vertical laminar air flow from the ceiling to the floor 18 of the room.

Figure 4:
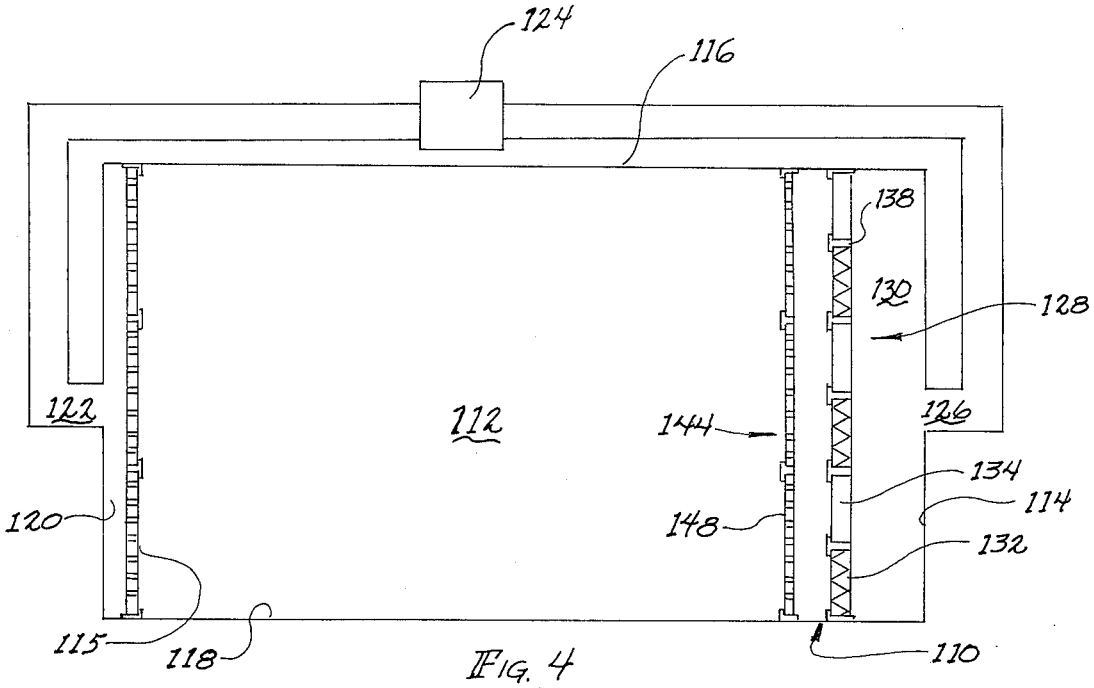
FIG. 4 is a cross-sectional view of an environmentally controlled enclosure having air filtering and distributing wall structure according to the present invention installed therein.

Now turning to FIG. 4, there is illustrated another embodiment of an air filtering and distributing structure of the present invention in the form of a ventilated wall construction, generally denoted as the numeral 110, installed in an environmentally controlled room 112 having walls 114, ceiling 116, a perforated wall 115 defining a return air plenum 120 behind it, and a floor 118.

The environmentally controlled room 112 further includes an air return duct 122 interconnecting the return air plenum 120 and a compressor 124 which may be associated with temperature and humidity control means (not shown) such as a furnace, air conditioner, humidifier, and dehumidifier; and an air supply duct 126 interconnecting the compressor to the room 112.

With continued reference to FIG. 4, the ventilated wall structure 110 comprises a first planar section such as a first wall, generally denoted as the numeral 128, spaced a predetermined distance from the room wall 114 and defining an air supply plenum 130 between the first spaced wall 128, room wall 114, ceiling 116 and floor 118. The first spaced wall 128 comprises a mixed array of filter panels 132 and blank panels 134. The filter panels 132 and blank panels 134 preferrably have the same lateral dimensions and are interchangeable. The number of filter panels 132 incorporated in the first spaced wall 128 is a function of the degree of air cleanliness required and will vary from installation to installation and consequently the pattern or arrangement of filter panels 132 will vary as a function of the number used to satisfy the air cleaning parameters. The blank panels 134 are disposed in the spaces between filter panels 132 to construct the first spaced wall 128 entirely comprised of filter panels 132 and blank panels 134 (see FIG. 5).

Figure 5:
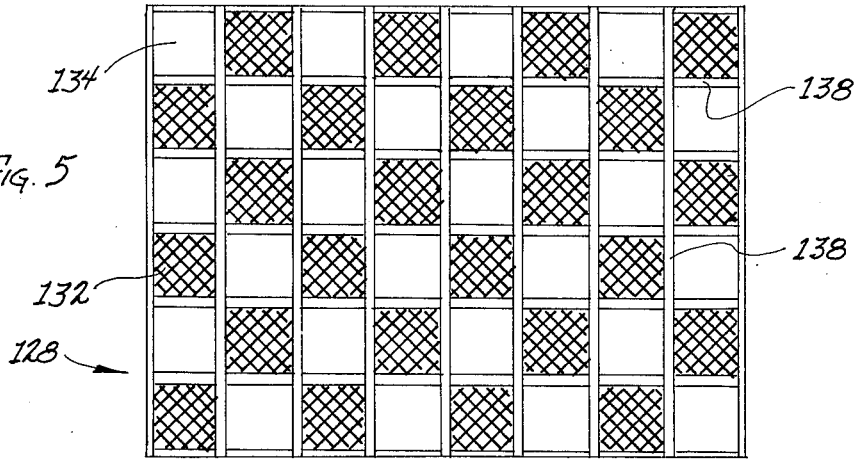
FIG. 5 is a front view of a first wall of the present invention as viewed from inside the enclosure; and, FIG. 6 is a front view of a second wall of the present invention as viewed from inside the enclosure.

A supporting structure for the first spaced wall 128 can be virtually any one of a number of heretofore known conventional structures. For example, the supporting structure is illustrated in FIGS. 4 and 5 as comprising a plurality of mutually perpendicular intersecting T-channel members 138 disposed in a vertical plane and defining a plurality of rectangular openings having lateral dimensions somewhat less than the lateral dimensions of the filter panels 132 and blank ceiling panels 134. The filter panels 132 and blank panels 134 are inserted in the openings and seated against the branches of the T-channel which extend inwardly of the openings. Additionally, a seal (not shown) is disposed between the filter panel 132 and blank panel 134 and the branch of the T-channel against which they are seated to prevent leakage of dirty air from the dirty air plenum 130. A number of conventional clips (not shown) can be used to retain the filter panels 132 and blank panels 134 in place against the branches of the T-channel.

Figure 6:
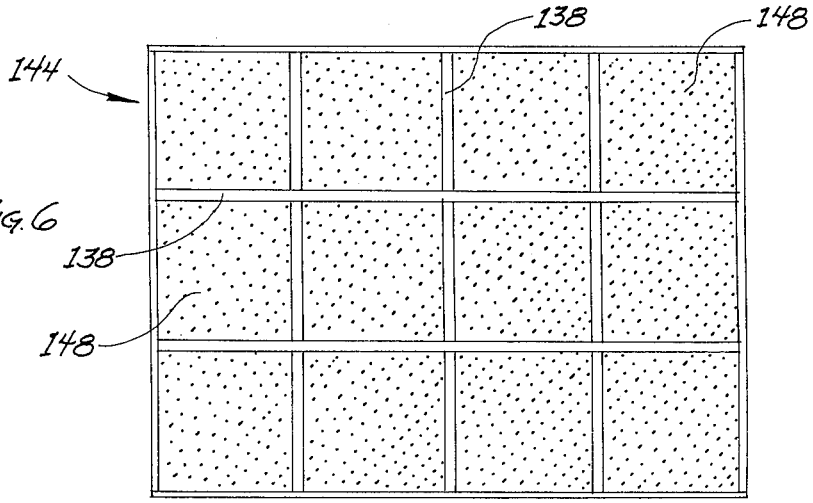

As can be seen in FIG. 4, the ventilated wall construction 110 is further comprised of a second planar section such as a second spaced wall, generally denoted as 144, spaced a predetermined distance from the first wall 128 to define a clean air plenum 146 between the second spaced wall 144 and first spaced wall 128. The second spaced wall 144 comprises a plurality of perforated air diffuser panels 148 which extend the width and height of the room (see FIG. 6).

As with the first spaced wall 128, the second spaced wall 144 can be supported by virtually any conventional structure and is illustrated as comprising the same type T-beam structure 138 as supports the first wall 128.

The filter panels 132 and blank panels 134 are easily removable from the support structure 138. This feature not only makes replacement of dirty filters easily accomplished, but also allows blank panels 134 to be easily replaced by filter panels 132 as air cleanliness requirements may be changed so that the wall structure 110 can be up-graded at a subsequent time after installation. Furthermore, the second wall 144 can be readily removed in the event that the first wall 128 is upgraded to contain all filter panels 132.

In operation, dirty air is received in the dirty air plenum 130 via the air supply duct 126 from the compressor 124, and the dirty air is filtered as it passes through the filter panels 132 of the first wall 128 into the clean air plenum 146. The perforated air diffusing panels 148 of the second wall 144 evenly distribute cleaned filtered air across the width and height of the room 112 as the clean air passes from the clean air plenum 146 and into the room 112. In the illustrated clean room 112, the air is drawn out of the room 112 through the perforated wall 115 into the return valve plenum 120 and out through the return duct 122, thus, providing generally horizontal laminar air flow across the room.

The foregoing detailed description is given primarily for clearness of understanding and no unnecessary limitations should be understood therefrom for modifications will be obvious to those skilled in the art upon reading the disclosure and may be made without departing from the spirit of the invention or the scope of the appended claims.

What is claimed is:

1. An air filtering and distribution structure for use in an environmentally controlled enclosure, said structure comprising:

a first planar section spaced a predetermined distance from one surface of said enclosure thereby defining a supply air plenum therebetween, said first section comprising a mixed array of air filter panels and blank panels, wherein said filter panels and said blank panels have substantially the same lateral dimensions and are interchangeable; and, a second planar section spaced a predetermined distance from and generally parallel to said first section thereby defining a clean air plenum therebetween, said second planar section comprising a plurality of perforated air diffusing panels for diffusing and evenly distributing clean air as the clean air passes from said clean air plenum into the enclosure.

2. The air filtering and distribution structure as defined in claim 1, wherein said filter panels and said blank panels are removably mounted in said first planar section.

3. The air filtering and distribution structure as defined in claim 1, wherein said second planar section is removably mounted in the enclosure.

4. The air filtering and distribution structure as defined in claim 3, wherein:

said first planar section is a first wall spaced a predetermined distance from a wall of the enclosure; and, said second planar section is a second wall spaced a predetermined distance from said first wall.

* * * * *